United States Patent [19]

Varner et al.

[11] Patent Number: 5,038,888

[45] Date of Patent: Aug. 13, 1991

[54] DESCENT CONTROLLER

[75] Inventors: Horace M. Varner; Ernest L. Stech; Richard H. Frost, all of Littleton, Colo.

[73] Assignee: Frost Engineering Development Corp., Englewood, Colo.

[21] Appl. No.: 554,687

[22] Filed: Jul. 18, 1990

[51] Int. Cl.[5] ..... A62B 1/14; B65H 59/14

[52] U.S. Cl. ..... 182/5; 188/65.2; 188/65.5

[58] Field of Search ..... 182/5, 6, 7; 188/65.1, 188/65.2, 65.4, 65.5

[56] References Cited

U.S. PATENT DOCUMENTS

| | | | |
|---|---|---|---|
| 386,237 | 7/1888 | Budd | 188/65.4 |
| 536,866 | 4/1895 | Fitzgerald | 188/65.4 |
| 771,251 | 10/1904 | Howe | 188/65.4 |
| 779,550 | 1/1905 | Leffelman | 188/65.2 |
| 1,115,603 | 11/1914 | Smith | 188/65.4 |
| 3,250,515 | 5/1966 | Hudnall | 182/5 |
| 3,351,158 | 11/1967 | Kite | 188/65.4 |
| 3,949,832 | 4/1976 | Hunter | 182/7 |
| 4,550,801 | 11/1985 | Forrest | 182/7 |
| 4,883,146 | 11/1989 | Varner | 182/5 |

*Primary Examiner*—Reinaldo P. Machado
*Attorney, Agent, or Firm*—Ralph F. Crandell

[57] ABSTRACT

A descent controller for lowering a load along a rope from an elevated position to a relatively lower position. The controller is a friction cylinder or capstan or a length adapted to receive a plurality of turns of rope between top and bottom end plates attached respectively adjacent the upper and lower ends of said cylinder. The end plates overhang the cylinder and define radial slots sized to loosely receive the rope. An upwardly narrowing tapered slot defined diametrically through the capstan receives and grips the rope. An annular clamp ring is slidably mounted on the cylinder and defines a radial aperture which loosely receives the rope as it exits from said tapered slot. A spring biases the ring upwardly along said friction cylinder for releasably wedging the rope in the tapered slot. A gripping cylinder is secured to the ring for sliding said ring along the friction cylinder to release said rope from the narrow end of said tapered slot. The gripping cylinder defines a housing enclosing the capstan and rope turns.

5 Claims, 3 Drawing Sheets

DESCENT CONTROLLER

BACKGROUND OF THE INVENTION

1. Field Of The Invention

The present invention relates to a descent controller for use in making a controlled descent from a higher elevation to a lower elevation along a rope or cable, and more particularly to a rope mounted descent control device including both a deadman brake and a panic brake.

2. Description Of The Prior Art

A descent control device with a deadman brake, in the form of a cylindrical drum or capstan about which a rope is wound and a tapered slot through the drum for receiving the rope along which descent is made, together with a releasable locking end plate, is shown in U.S. Pat. No. 4,883,146, issued Nov. 28, 1989, to H. M. Varner and E. L. Stech for "DESCENT CONTROL DEVICE WITH DEADMAN BRAKE." The device shown in the patent to Varner et al. includes end plates on each end of a cylindrical drum or capstan with apertures on each end plate through which a rope is threaded. The ropes is wound in two or more turns around the drum. The lower plate is provided with an arcuate tapered slot opening into the rope receiving aperture for engaging and binding the rope in order to provide a brake. The rope is mechanically forced into the aperture by a locking end plate rotatably mounted on the capstan below the lower end plate. The locking plate includes an aperture for loosely receiving the rope. A spring rotatably biases the locking plate to releasably and forcibly urge the rope into the narrowed tapered slot in the lower end plate for locking the rope against movement on the capstan. By rotating the locking plate against the force of the spring the rope can be released from the tapered slot.

Tapered slots are ancient and well known in the art of releasably fastening ropes, lines and cables, such as in the nautical field where tapered slots re widely used for engaging and retaining ropes, lines, hawsers and cables. The use of cylindrical capstans for holding and providing a mechanical advantage for tightening ropes is also old and well known. Likewise, a variety of fire escape devices utilizing a rope wound around a cylinder, are old and well known. See, for example, U.S. Pat. No. 4,550,801, issued Nov. 5, 1985, to W. E. Forrest for "PERSONAL HIGH RISE EVACUATION APPARATUS"; U.S. Pat. No. 771,251, issued Oct. 4, 1904, to 0. Howe for "FIRE ESCAPE"; U.S. Pat. No. 386,237, issued July 17, 1888, to T. Budd for "FIRE ESCAPE"; U.S. Pat. No. 1,115,603, issued Nov. 3, 1914, to J. Smith for "FIRE ESCAPE"; and U.S. Pat. No. 536,866, issued Apr. 2, 1895, to C. FitzGerald for "FIRE ESCAPE."

OBJECTS AND SUMMARY OF THE INVENTION

It is the principal object of the present invention to provide an improved load lowering descent controller of the type embodying a cylindrical body about which a rope or cable is turned, which includes both a deadman safety control providing a fail-safe descent device, and a panic control to stop or substantially retard descent of the device in the event of a panic actuation of the controller.

Another object of the present invention is to provide a descent controller of the foregoing character which may be actuated by pulling on the free end of the rope along which descent is made thereby enabling and facilitating the lowering and descent of a load such as an unconscious user.

A further object of the present invention is to provide a descent controller of the foregoing character which incorporates energy absorbing characteristics to provide for shock loading when in the locked position and to provide for a controlled descent after absorption of the shock.

DESCRIPTION OF THE PREFERRED EMBODIMENT

Figure 1:
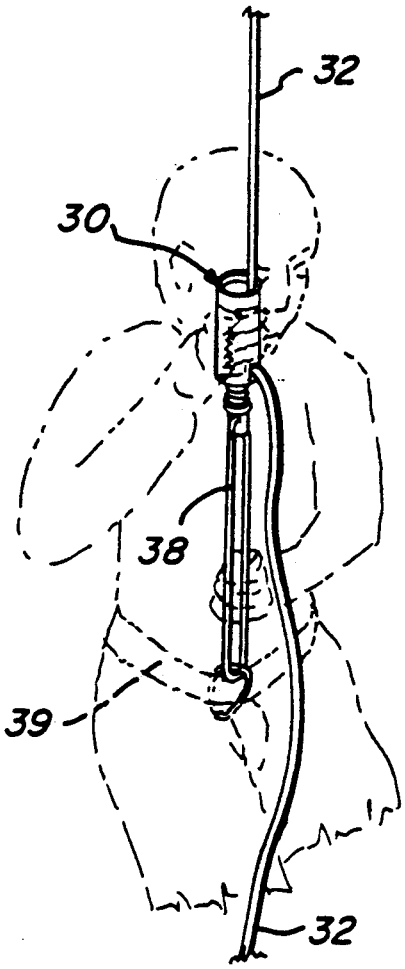
FIG. 1 is a perspective view of a descent controller embodying the present invention and illustrating how the controller is utilized by a user supported in a safety harness suspended from the controller for descent along a supporting rope.
Figure 2:
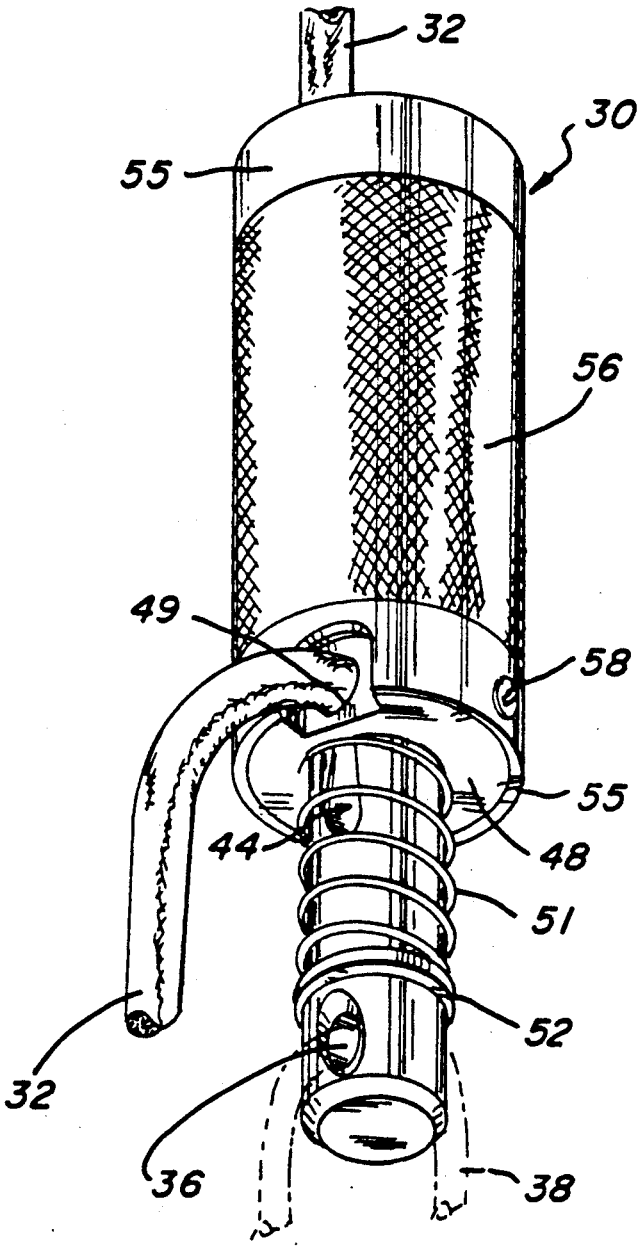
FIG. 2 is an enlarged perspective view of the descent controller shown in FIG. 1 mounted on a supporting rope.
Figure 3:
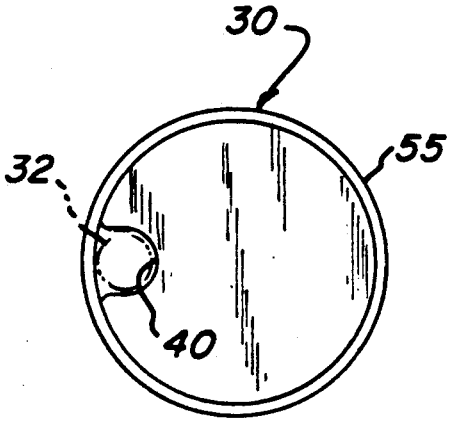
FIG. 3 is a top plan view of the descent controller shown in FIG. 2.
Figure 4:
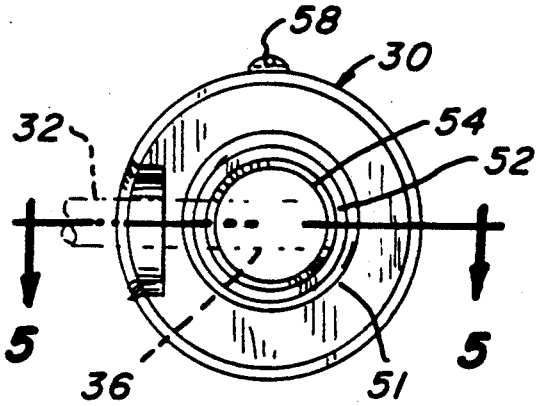
FIG. 4 is a bottom plan view of the descent controller shown in FIG. 2.

The descent controller 30 embodying the present invention is formed by a vertically oriented capstan 31 such as a cylinder shaft or drum about which a length of rope or line 32 is wound. The number of turns of rope is the principal determinate of the capstan ratio or force reduction. The rope 32 is secured at one end at an elevated point (not shown) above the ground and hangs downwardly to the ground or other platform (not shown). The descent controller 30 is mounted on the rope to enable the user or a load to descend slowly and controllably along the rope from the elevated point to the lower point, ground or platform. The descent controller is of the capstan type in which the rope is wound in a number of turns around a capstan 31 thereby providing a mechanical advantage enabling the user or load to descend slowly along the rope as the rope hangs from the elevated point. The controller 30 includes means for selecting gripping the rope and preventing descent or releasing the rope to provide for the controlled descent. In one extreme position or deadman position, the controller grips the rope tightly and prevents descent. In the opposite or panic position, the controller temporarily grips the rope to prevent or substantially retard the descent. In the case of a user for example who might believe the descent is too fast and panics by grabbing onto the controller and jamming it downwardly descent will stop or slow as a result of friction engagement between the controller and the rope. In the normal descent position the rate of descent is determined by the number of turns of rope wrapped around the capstan or friction cylinder.

A modified form of the present invention allows the descent controller to be mounted on or removed from the rope at any point between its ends, and similarly allows for adjustment in the number of turns of the rope about the capstan thereby providing for adjustment of the descent rate. It must be understood, however, the once the descent has started the number of turns of the rope about the capstan can not be adjusted. It is therefore desirable to adjust the controller at a safe elevation before depending upon it at a higher elevation.

The controller finds substantial but not necessarily exclusive utility as a safety device for use with scaffolding, lifts, forklifts, trucks, stock pickers, snorkels and the like as well as for fire or emergency escapes from tall buildings, cranes, scaffolds, window washing platforms and the like.

As shown in FIGS. 1–12 the capstan or friction cylinder 31 includes an upper flange 34 adjacent its upper end and a lower flange 35 nearer but spaced from the lower end of the capstan cylinder 31. Juxtaposed with the lower end of the capstan cylinder 31 is a diametric aperture or bore 36 defined therein for receiving a supporting rope, hook, loop or the like 38 for engaging and supporting a load suspension structure or harness 39. Each of the top and bottom or upper and lower flanges 34, 35 includes a rope receiving guide notch 40, 41 respectively, defined therein for receiving an inserted portion of the rope 32. The rope 32 is wound in a number coils or turns 42 about the capstan or friction cylinder 31 between the upper and lower flanges 34, 35.

For controllably gripping the rope, the lower end of the capstan or cylinder 31, being the portion extending below the lower flange 35, is provided with a diametrically extending upwardly tapered slot 44, of generally teardrop shape. The slot 44 tapers from a lower enlarged end 45 which loosely receives the rope 32 to an upper narrow or gripping end 46 which frictionally grips the rope 32. A rope 32 passing through the lower open end 45 of the slot 44 moves freely through the slot. However, the rope is tightly gripped and restrained by the upper or narrower end 46 of the slot 44.

Figure 5:
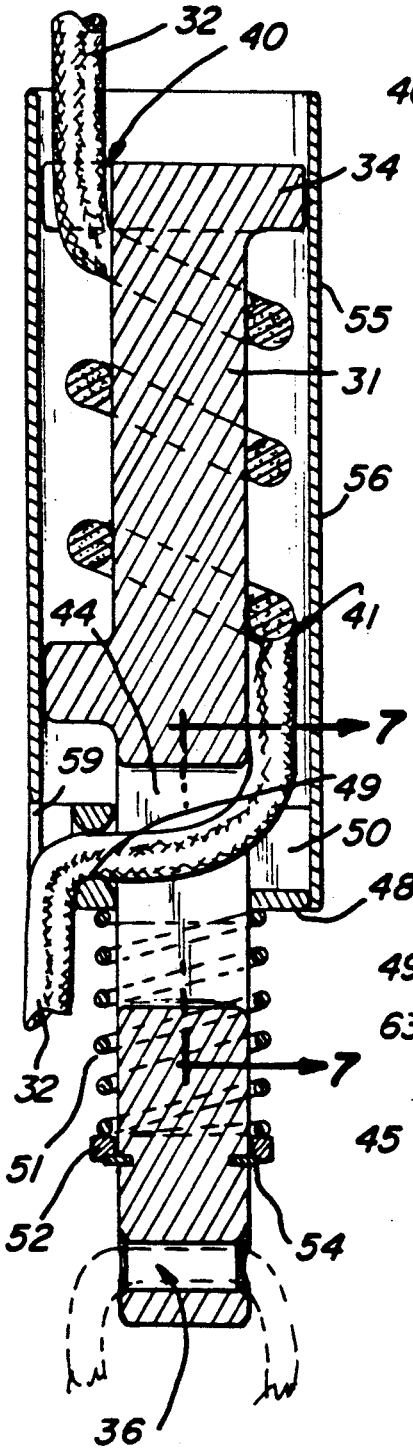
FIG. 5 is a section view taken substantially in plane of line 5—5 on FIG. 4.
Figure 6:
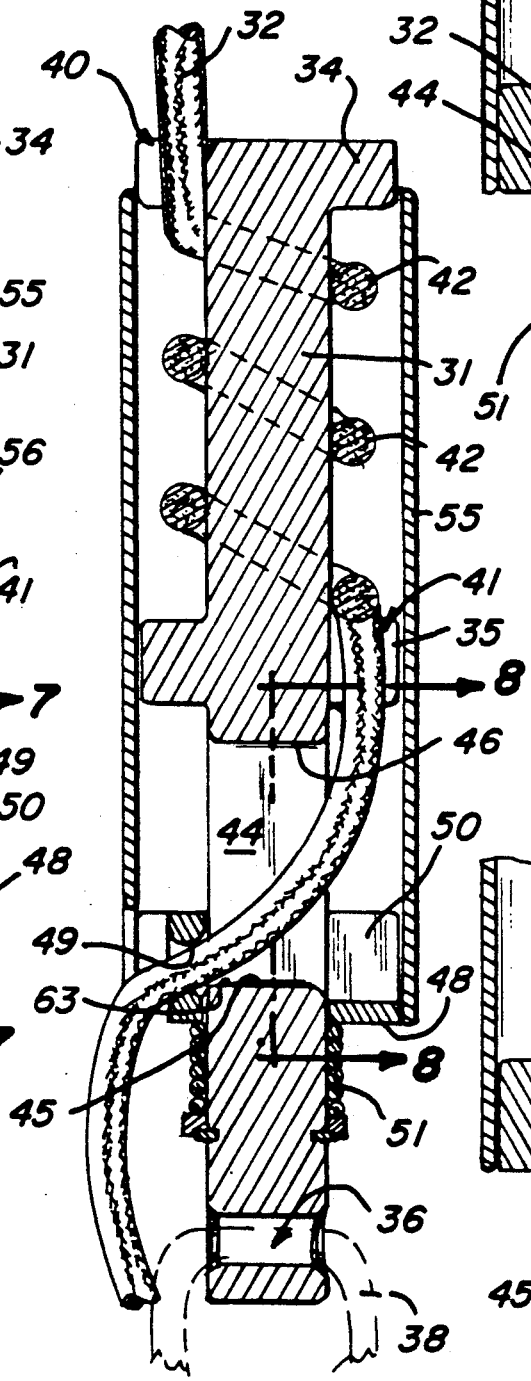
FIG. 6 is a section view similar to FIG. 5 but showing the descent controller released in rope descending configuration.
Figure 7:
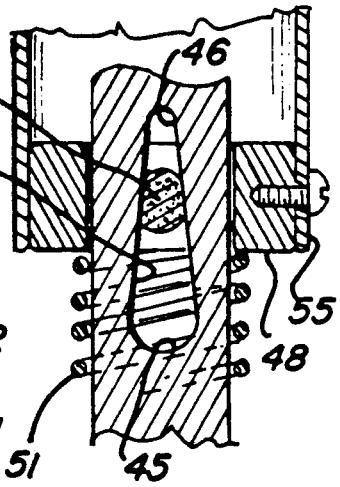
FIG. 7 is a section view taken substantially in the plane of line 7—7 on FIG. 5.
Figure 8:
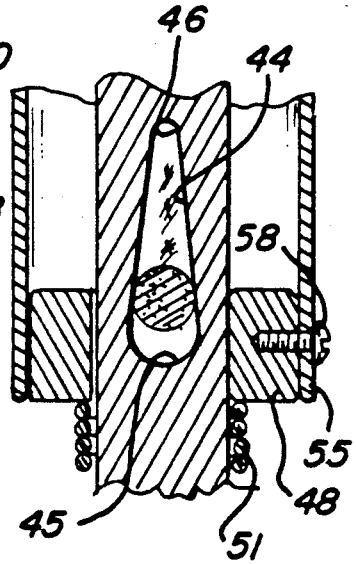
FIG. 8 is a section view taken substantially in the plane of line 8—8 on FIG. 6.
Figure 9:
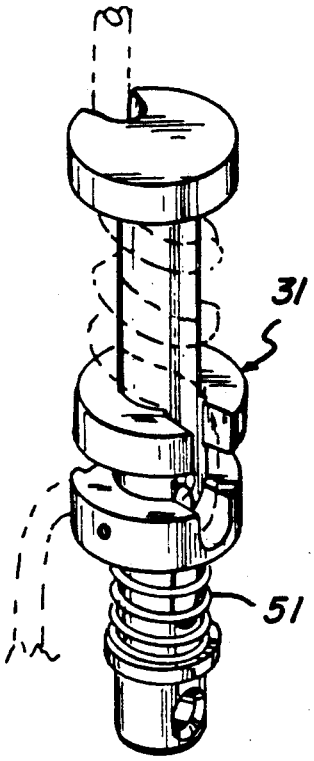
FIG. 9 is a perspective view of a capstan and rope clamping control ring as shown in FIGS. 2 and 5, but with the cover removed.
Figure 11:
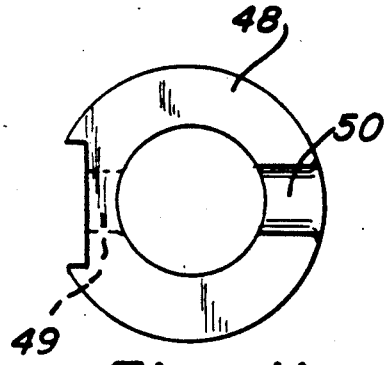
FIG. 11 is a top plan view of the clamping ring taken substantially in the plane of line 11—11 on FIG. 10.
Figure 12:
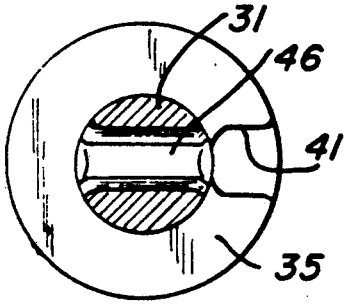
FIG. 12 is a section view taken substantially in the plane of line 12—12 on FIG. 10.
Figure 10:
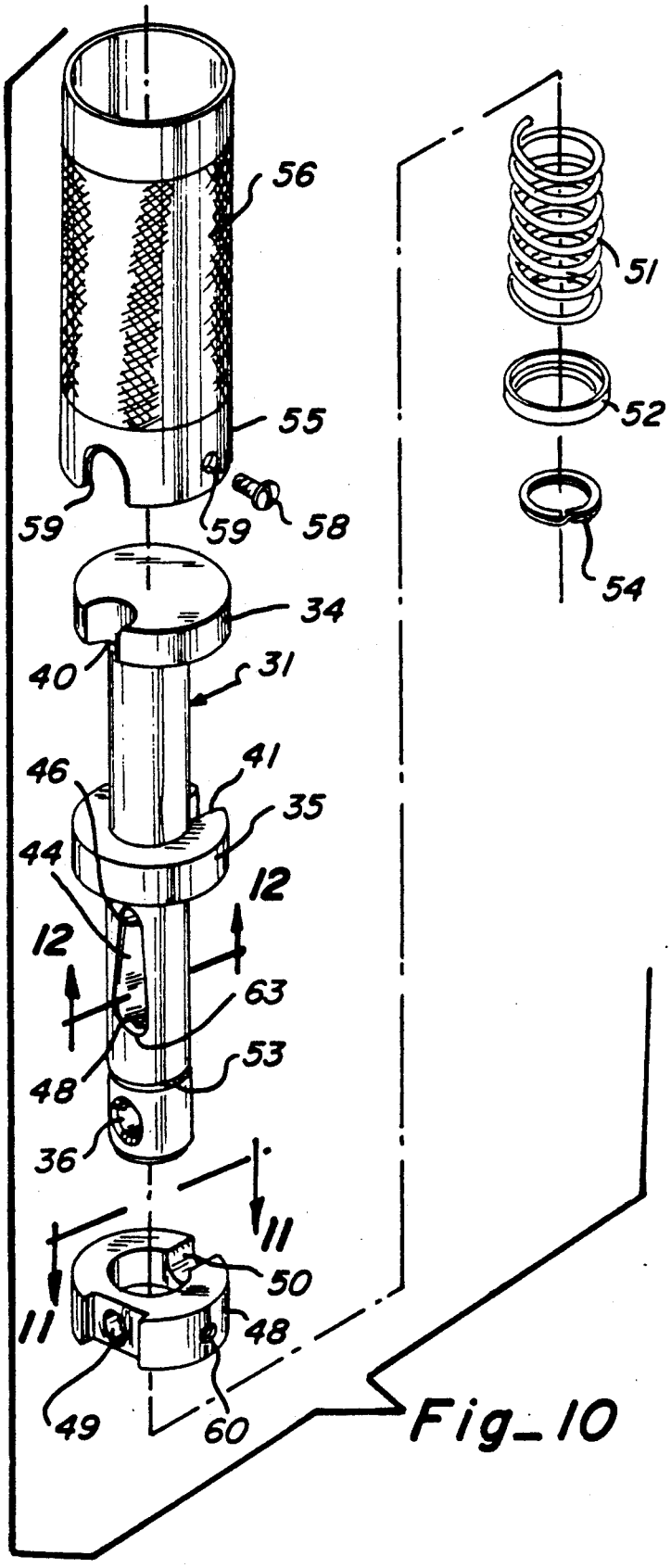
FIG. 10 is an exploded perspective view, somewhat reduced in size, of the descent controller shown in FIG. 2.

For positively positioning the rope 32 in either the lower enlarged end 45 or upper constricted end 46 of the slot 44, there is provided an annular sleeve or control ring 48 slidably mounted on the lower or depending end of the friction cylinder or capstan 31 as shown in FIGS. 5 and 6. The control ring 48 includes a radial aperture 49 defined therein for loosely receiving the rope 32. The edges of the aperture 49 may be chamfered or rounded to prevent cutting or damaging the rope. The sliding control ring also includes a recess 50 for receiving the rope allowing the rope to pass freely through the enlarged lower end of the tapered slot 44 without interference from the positioning ring 48 when the ring is in its lower position, as well as for receiving the rope to allow the ring to force or jam the rope into the narrow tapered slot 44 when the ring 48 is in its upper position. The ring is biased towards its upper rope gripping position by a coil spring 51 or other appropriate biasing device. The spring 51 is supported on a shoulder ring 52 secured by a C-clamp or like clamp 54 engaging in a groove 53 in the lower end of the friction cylinder 31 adjacent the load supporting aperture 36.

The control ring 48 is adapted to be moved up and down over the capstan cylinder 31 by a tubular sleeve or housing 55 secured thereto and extending in surrounding covering relation with the capstan 31, rope turns, and both the upper and lower flanges 34, 35 on the capstan. The housing 55 is provided with a knurled, grooved or roughened outer surface 56 to enable a user to readily grip the housing surface without slipping. The housing is secured to the control ring by one or more screws 58 or appropriate latches or detents. Adjacent its lower edge the housing 55 is provided with a longitudinal peripheral notch 59 which corresponds with the rope aperture 49 of the control ring and through which the rope 32 loosely extends. As described above, the cylinder or housing 55 provides a knurled or like gripping surface 56 which a user may grasp with one or both hands in order to position the control ring 48 in either locking or descent position.

For certain applications such as for lowering a dead load, the tapered slot 44, may be reversed so that the device can be controlled from a ground level by pulling on or releasing the rope tension.

The device as described also provides for a panic stop because a hard, pull-down force on the sleeve and control ring will jam the rope between the control ring and the bottom 45*a* of the tapered slot thereby pinching the rope and creating a substantial drag on it. Thus, if a user in panic pulls down hard on the control housing and control ring, the device will stop or retard further descent until the downward force on the control housing and ring is released. In the event of a deadman fall on the other hand, the control ring will jam the rope in the upper tapered end of the slot to prevent or retard further descent. The device thus provides for a controlled descent under both deadman and panic conditions.

The foregoing descent controller device provides a safe controllable means for a person located high above the ground or floor to descend on a rope. Applications include but are not limited to egress from overhead crane cabs, forklift or stockpicker cabs, and the buckets on high-lift utility vehicles. In addition, the device may be used for the evacuation of buildings, bridges, structures, platforms, ships, or aircraft where the descent distance is sufficient to cause injury if the user jumps without a control means. Another application is for the rescue of persons trapped in a building by fire, stranded on a ledge on a mountain, or similar situations. Police special weapons teams and armed forces special forces personnel can use the device effectively for controlled descent from buildings, ledges, mountains, and other similar conditions.

While a certain illustrative embodiment has been shown in the drawings and described above in considerable detail it should be understood that there is no intention to limit the invention to the specific form disclosed. On the contrary the intention is to cover all modifications, alternative constructions, equivalents and uses falling within the spirit and scope of the invention as expressed in the appended claims.

We claim:

1. A descent controller for lowering a load along a rope from an elevated position to a relatively lower position, said controller including a friction cylinder of a length adapted to receive a plurality of turns of rope wrapped therearound, said cylinder having an upper end and a lower end, top and bottom end plates attached respectively adjacent the upper end and spaced from the lower end of said cylinder, said end plates both having a portion thereof overhanging the cylinder and defining radial slots sized to loosely receive the rope, a portion of said friction cylinder extending below said lower end plate and defining diametrically therethrough an upwardly narrowing tapered slot adapted to receive the rope, said tapered slot defining an enlarged entryway adapted to freely admit the rope and tapering from said entryway to a relatively constricted end of a width sufficient for gripping the rope, an annular controlling slidably mounted on said cylinder below said bottom end plate and defining radially therethrough an aperture adapted to loosely receive said rope as it exits from said tapered slot, a spring biasing said ring upwardly along said friction cylinder for wedging said rope in said tapered slot, a sleeve secured to said ring for use in sliding said ring along said friction cylinder against the force of said biasing spring to release said rope from the narrow end of said tapered slot, said sleeve defining a housing enclosing said friction cylinder and the rope wrapped therearound, and means on the lower end of said friction cylinder below said tapered slot for engagement with a load support, whereby said descent controller supports a load on said rope and upon sliding movement of said sleeve provides for a controlled descent of said supported load along said rope.

2. A descent controller for lowering a load along a rope from an elevated position to a relatively lower position, said controller including a friction cylinder of a length adapted to receive a plurality of turns of rope wrapped therearound, said cylinder having an upper end and a lower end, top and bottom end plates attached respectively adjacent the upper end and spaced from the lower end of said cylinder, said end plates both having a portion thereof overhanging the cylinder and defining radial slots sized to loosely receive the rope, a portion of said friction cylinder extending below said lower end plate and defining an upwardly narrowing tapered slot diametrically therethrough adapted to receive the rope, said tapered slot defining an enlarged entryway adapted to freely admit the rope and tapering from said entryway to a relatively constricted end of a width sufficient for gripping the rope, an annular control ring slidably mounted on said cylinder below said bottom end plate and defining a radial aperture therethrough adapted to loosely receive said rope as it exits from said tapered slot, a spring biasing said ring upwardly along said friction cylinder for wedging said rope in said tapered slot, said control ring being slidable along said friction cylinder away from said bottom end plate for releasing said rope from the narrow end of said tapered slot, and means on the lower end of said friction cylinder below said tapered slot for engagement with a load support whereby said descent controller supports a load on said rope and upon sliding movement of said control ring provides for a controlled descent of said supported load along said rope.

3. A descent controller as defined in claim 2 further comprising a gripping sleeve secured to said control ring for use in sliding said control ring along said friction cylinder.

4. A descent controller as defined in claim 3 wherein said gripping sleeve defines a housing enclosing said friction cylinder and the rope wrapped therearound.

5. A descent controller for lowering a load along a rope from an elevated position to a relatively lower position, said controller including a friction cylinder of a length adapted to receive a plurality of turns of rope wrapped therearound, said cylinder having an upper end and a lower end, top and bottom end plates attached respectively adjacent the upper end and spaced from the lower end of said cylinder, said end plates both having a portion thereof overhanging the cylinder and defining radial slots sized to loosely receive the rope, a portion of said friction cylinder extending below said lower end plate and defining means for releasably gripping said rope, means slidably mounted on said cylinder below said bottom end plate for positioning said rope with respect to said gripping means, means secured to said rope positioning means for sliding said rope positioning means along said friction cylinder to release or engage said rope with said gripping means, and means on the lower end of said friction cylinder for engagement with a load support whereby said descent controller supports a load on said rope and upon sliding movement of said sliding means provides for a controlled descent of said supported load along said rope.

* * * * *